United States Patent [19]

Das et al.

[11] Patent Number: 4,718,475

[45] Date of Patent: Jan. 12, 1988

[54] APPARATUS FOR CASTING HIGH STRENGTH RAPIDLY SOLIDIFIED MAGNESIUM BASE METAL ALLOYS

[75] Inventors: Santosh K. Das, Randolph; Derek Raybould, Denville; Richard L. Bye, Jr., Morris Township, Morris County; Chin-Fong Chang, Lake Hiawatha, all of N.J.

[73] Assignee: Allied Corporation, Morris Township, Morris County, N.J.

[21] Appl. No.: 16,892

[22] Filed: Feb. 20, 1987

Related U.S. Application Data

[62] Division of Ser. No. 618,289, Jun. 7, 1984, Pat. No. 4,675,157.

[51] Int. Cl.[4] ..... B22D 11/06

[52] U.S. Cl. ..... 164/415; 164/429

[58] Field of Search ..... 164/423, 427, 429, 463, 164/479, 475, 415

[56] References Cited

FOREIGN PATENT DOCUMENTS 53-35005 9/1978 Japan ..... 164/423

57-137058 8/1982 Japan ..... 164/463

*Primary Examiner*—Kuang Y. Lin

*Attorney, Agent, or Firm*—Ernest D. Buff; Gerhard H. Fuchs

[57] ABSTRACT

An apparatus for casting magnesium based alloy containing dispersed magnesium intermetallic phases comprises scraping means and shielding means to form a semi-closed chamber around a casting nozzle. Gas supply means is provided for supplying inert gas to the chamber.

1 Claim, 10 Drawing Figures

$Mg_{88}Al_{10}Si_2$
(as extruded)

APPARATUS FOR CASTING HIGH STRENGTH RAPIDLY SOLIDIFIED MAGNESIUM BASE METAL ALLOYS

This application is a division of application Ser. No. 618,289, filed June 7, 1984, now U.S. Pat. No. 4,675,157.

DESCRIPTION

1. Field of Invention

This invention relates to high strength magnesium based metal alloys, and more particularly to ribbon and powder products made by rapid solidification of the alloys and to bulk articles made by consolidation of the powder.

2. Description of the Prior Art

It is known that rapid solidification processing (RSP) effects microstructural refinements in many alloy systems, which provide such systems with distinct advantages. The high cooling rates ($\sim 10^{5°}$–$10^{7°}$ C./sec) obtained with RSP can product extended solid solubility, metastable phases, fine intermetallic dispersoids and reduce compositional segregation, all of which contribute to improved mechanical properties (see Proceedings of International Conference on Rapid Solidification Processing II eds. R. Mehrabian, B. H. Kear and M. Cohen, Claitors Publishing Division, Baton Rouge, LA 1980). This has been demonstrated for nickel, iron and aluminum based alloys (U.S. Pat. No. 4,347,076) and more recently for titanium-based alloys (Journal of Metals, September 1983, p. 21). However, RSP has not been widely used to improve mechanical properties of magnesium base alloys.

Amorphous ribbons of the composition $Mg_{70}Zn_{30}$ (composition in atomic percent) have been made by melt spinning (A. Calka, M. Madhava, D. E. Polk, B. C. Giessen, H. Matyja and J. Vander Sande, Scripta Metallurgica, Vol. 11, p. 65, 1977). These ribbons are brittle when consolidation and have not been useful in structural applications.

Microcrystalline magnesium alloys containing 1.7 to 2.3 atom percent Zn have been cast into ribbon by melt spinning. The homogeneous solid solution range of such ribbon is limited to a chill zone (the ribbon surface next to the quenching substrate) of 10 to 20 μm wide, beyond which a two phase region is observed (L. J. Masur, J. T. Burke, T. Z. Kattamis and M. C. Flemings, in Rapidly Solidified Amorphous and Crystalline Alloys, eds. B. H. Kear, B. C. Giessen and M. Cohen, Elsevier Science Publishing Co., 1982, p. 185). Microcrystalline $Mg_{100-x}Zn_x$ alloys with x=26–32 atom percent have been produced by crystallization of amorphous splats prepared by gun technique (P. G. Boswell, Materials Science and Eng., Vol. 34, 1978, p. 1). More recently $Mg_{74}Li_{26}$, $Mg_{73.5}Li_{25.8}Si_{0.7}$ and $Mg_{73.96}Li_{25.9}Ce_{0.14}$ alloys have been made as rapidly solidified flakes by twin roller quenching (P. J. Mescheter and J. E. O'Neal, Met. Trans., Vol. 15A, 1984, p. 237). However, in all of the aforementioned studies, no attempt has been made to determine the mechanical properties of either the amorphous or microcrystalline alloys. A recent study involved mechanical properties of a rapidly quenched magnesium alloy prepared by consolidation of powder made by rotating electrode process using commercial alloy ZK60A (Mg-6 wt%Zn-0.45 wt%Zr) (S. Isserow and F. J. Rizzitano, Intn'l. J. of Powder Metallurgy and Powder Tech., Vol. 10, p. 217, 1974). However, the average particle size they obtained using rotating electrode process is about 100 μm and the cooling rate for such particles is $<10^4$ K/s (e.g. N. J. Grant, Journal of Metals, Vol. 35, No. 1, p. 20, 1983). However, consolidation of such powders using conventional consolidation techniques usually leads to coarsening of microstructure.

There remains a need in the art of rapidly solidified magnesium alloys containing uniform dispersions of intermetallic compounds that provide the alloys with high tensile strength.

SUMMARY OF THE INVENTION

The present invention provides a high strength, corrosion resistant magnesium based alloy which can be formed into ribbon or powder and which is especially suited for consolidation into bulk shapes having a fine microstructure. Generally stated, the alloy has a composition consisting essentially of about 0 to 11 atom percent aluminum, about 0 to 4 atom percent zinc, about 0.5 to 4 atom percent of at least one element selected from the group consisting of silicon, germanium, cobalt, tin and antimony, the balance being magnesium and incidental impurities, with the proviso that the sum of aluminum and zinc present ranges from about 2 to 3 atom percent. In addition, up to 4 at% of aluminum and zinc present can be replaced by at least one element selected from the group consisting of neodymium, yttrium, cerium and manganese. The invention also provides a method and apparatus wherein the magnesium alloys of present invention are subjected to rapid solidification processing by using a melt spin casting method wherein the liquid alloy is cooled at rate of $10^{5°}$ to $10^{7°}$ C./sec while being formed into a solid ribbon or sheet. That process further comprises the provision of a means to protect the melt puddle from burning, excessive oxidation and physical disturbance by the air boundary layer carried with the moving substrate. Said protection is provided by a shrouding apparatus which serves the dual purpose of containing a protective gas such as a mixture of air or $Co_2$ and $SF_6$, a reducing gas such as CO or an inert gas, around the nozzle while excluding extraneous wind currents which may disturb the melt puddle.

The alloying elements silicon, germanium, cobalt, tin and antimony have limited solubility in magnesium, upon rapid solidification processing, they form a fine uniform dispersion of intermetallic phases such as $Mg_2Si$, $Mg_2Ge$, $Mg_2Sn$, $Mg_2Sb_3$, $MgCo_2$, depending on the alloy composition. These finely dispersed intermetallic phases increase the strength of the alloy and help to maintain a fine grain size by pinning the grain boundaries during consolidation of the powder at elevated temperature. The addition of the alloying elements aluminum and zinc contributes to strength via matrix solid solution strengthening and by formation of certain age hardening precipitates e.g. $Mg_{17}Al_{12}$, MgZn. Substitution of aluminum and zinc by neodymium, praseodymium, yttrium and manganese fully or in part further contributes to strength by age hardening precipitates.

This invention also provides a method of forming consolidated metal alloy article. The method includes the step of compacting powder particles of the magnesium based alloy of the invention. The particles can be cold pressed, or warm pressed by heating in a vacuum to a pressing temperature ranging from 150° C. to 300° C., which minimizes coarsening of the dispersed, intermetallic phases. The powder particles can also be consolidated into bulk shapes using conventional methods such as extrusion, forging and superplastic forming.

Additionally, the invention provides a consolidated metal article made from magnesium based alloys of the invention. The consolidated article has a combination of ultimate tensile strength (up to 494 MPa (71.7 ksi)) and ductility at room temperature, which is far superior to conventional magnesium alloys. The articles are suitable for applications as structural members in helicopters, missiles, air frames and as sabots where high specific strength (ratio of strength to density) is important.

BRIEF DESCRIPTION OF THE DRAWINGS

The invention will be more fully understood and further advantages will become apparent when reference is made to the following detailed description and the accompanying drawings, in which:

FIG. 5(*b*) is an x-ray spectrum taken from the particle shown by the arrow in FIG. 5(*a*);

FIG. 5(*c*) is an x-ray spectrum taken from the particle shown by double arrows in FIG. 5(*a*)

DETAILED DESCRIPTION OF THE INVENTION AND THE PREFERRED EMBODIMENTS

Figure 1:
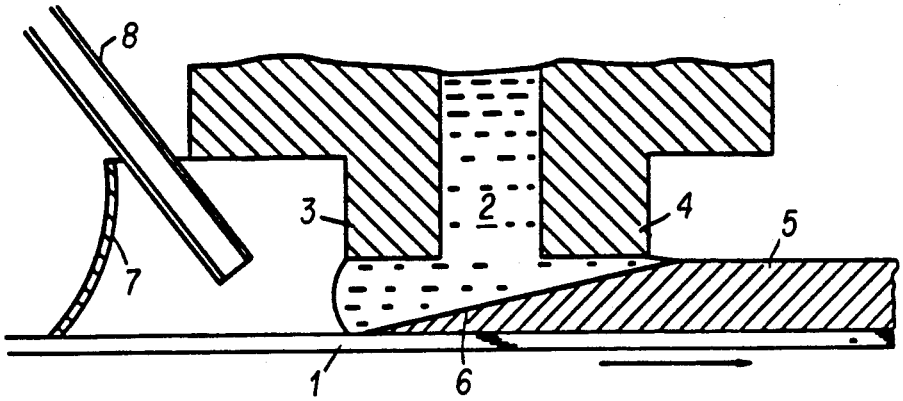
FIG. 1 is a side cross section illustrating the relationship between the substrate, scraper, the inert or reducing gas inlet, and the nozzle through which metal is deposited on the moving chill surface.

FIG. 1 shows a partial cross sectional side view illustrating the method by which the alloys of the present invention are cast. As shown in FIG. 1, molten metal 2 of the desired composition is forced under pressure through a slotted nozzle defined by a first lip 3 and a second lip 4 onto the surface of a chill body 1 which is held in close proximity to the nozzle and moves in the direction indicated by the arrow. A scraping means including scraper 7 is located in contact with the chill substrate and a protective gas is introduced by a gas supply means through a gas inlet tube 8.

Figure 2:
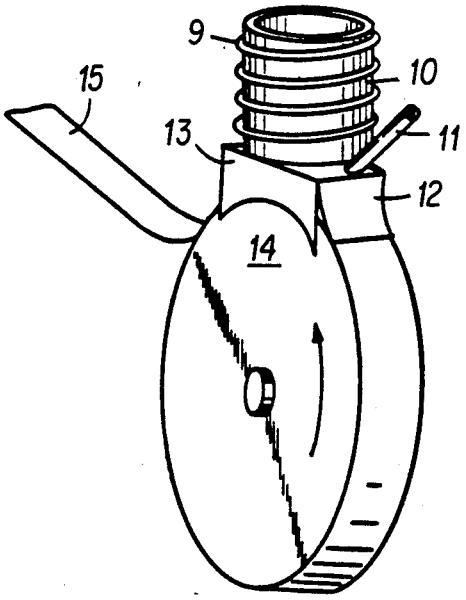
FIG. 2 is a perspective view illustrating a manner of arrangement of the substrate scraper and the side shields which arrangement provides a semi-enclosed chamber that directs and confines the inert or reducing gas in the vicinity of the nozzle opening.
Figure 3:
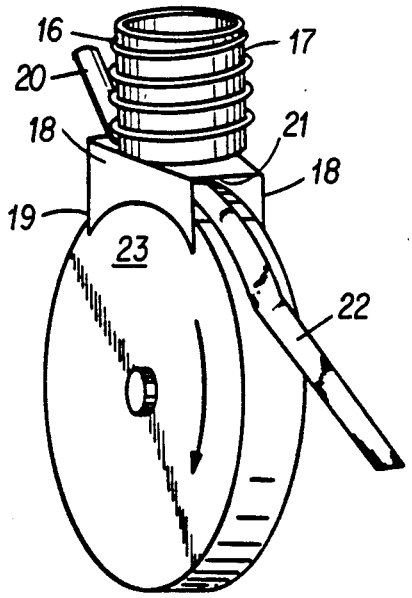
FIG. 3 is a perspective view, taken from the side opposite to shown in FIG. 2, illustrating the substrate scraper and side shields arrangement.

FIGS. 2 and 3 are simplified perspective views from two different angles showing, with reference to FIG. 3 how side shields 18 are used in conjunction with the scraper 19 and the gas inlet tube 20, to provide a semienclosed chamber around the nozzle 21. In addition it has been found that the presence of the scraper and side shields markedly improves the effectiveness of the protective gas. The scraper helps in removing the air boundary layer and, therefore, creating a low pressure area behind it which is filled by the protective gas. Without side shields, however, extraneous wind currents generated by the moving substrate assembly, can distort the gas flow so that it does not uniformly impinge upon the nozzle and melt puddle. Under these conditions, the ribbon is apt to be formed non-uniformly. In particular, one or both ribbon edges tend to be irregular. It has been found, however, that when side shields are used in conjunction with the scraper blade and protective gas, the gas flow pattern is uniform and consistent and ribbon can be cast reliably.

The precise dimensions and location of the scraping means, gas supply and shielding means are not critical, but it has been found that several general concepts should be adhered to. The scraping means, gas supply and shielding portions of the casting apparatus, that is, the side shields, scraper blade, and gas inlet tube should be located to ensure that a uniform gas flow pattern is maintained. In general, the opening of the gas inlet tube should be located within 2 to 4 inches of the nozzle. The scraper should be positioned as close as is practical to the gas inlet tube to ensure that the protective gas flows into the low pressure area behind it and not the ambient atmosphere. The side shields should be located so that they extend from the scraper to a point roughly 2 to 3 inches past the nozzle slot. The shields should be of a height such that they are close to or in contact with the substrate assembly at the bottom and the underside of the nozzle or nozzle support at the top. The nozzle or nozzle support should be such that when it is in the casting position, the scraper, the side shields and the underside of the nozzle support form a semi-enclosed chamber around the nozzle slot which maximizes the effect of the inert or protective gas, as shown in FIGS. 2 and 3.

The protective gas is any gas or gas mixture capable of replacing the ambient atmosphere in the vicinity of the nozzle and minimizing oxidation of the melt puddle. Preferred protective gases include helium, nitrogen, argon, carbon monoxide, mixtures of carbon dioxide and sulfur hexafluoride and the like.

In accordance with the present invention nominally pure magnesium is alloyed with about 0 to 11 atom percent aluminum, about 0 to 4 atom percent zinc, about 0.5 to 4 atom percent of at least one element selected from the group consisting of silicon, germanium, cobalt, tin and antimony, the balance being magnesium and incidental impurities, with the proviso that the sum of aluminum and zinc present ranges from about 2 to 13 atom percent. The alloys are melted in a protective environment; and quenched in a protective environment at a rate of at least about $10^{5°}$ C./sec by directing the melt into contact with a rapidly moving chilled surface to form thereby a rapidly solidified ribbon. Such alloy ribbons have high strength and high hardness (i.e. microVickers hardness of at least about 125 kg/mm$^2$. When aluminum is alloyed without addition of zinc, the minimum aluminum content is preferably above about 6 atom percent. In the alloys discussed above up to 4 atom percent of the aluminum and zinc present is replaced by at least one element selected from the group consisting of neodymium, praseodymium, yttrium, cerium and manganese. In addition, up to 0.3 atom percent of the silicon, germanium, cobalt, tin and antimony present in the alloy is replaced by zirconium.

The alloys of the invention have a very fine microstructure which is not resolved by optical microscopy. Transmission electron microscopy reveals a substantially uniform cellular network of solid solution phase ranging from 0.2–1.0 μm in size, together with precipitates of very fine, binary or ternary intermetallic phases which are less then 0.5 μm and composed of magnesium and other elements added in accordance with the invention.

Figure 4A:
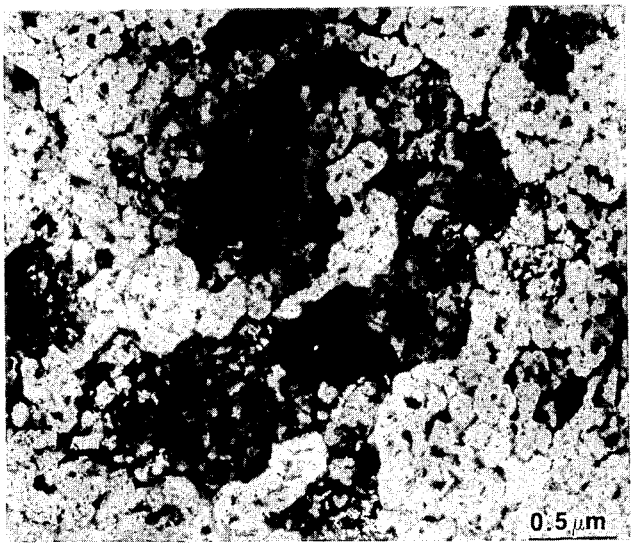
FIG. 4 is a transmission electron micrograph of ascast ribbon of the alloy $Mg_{89.5}Zn_1Al_8Si_1Nd_{0.5}$ illustrating the fine grain size and particles thereof.

In FIG. 4 there is illustrated the microstructure of a ribbon cast from alloys consisting essentially of the composition $Mg_{89.5}Al_8Zn_1Nd_{0.5}Si_1$. The microstructure shown is typical of samples solidified at cooling rate in excess of $10^{5°}$ C./sec and is responsible for high hardness ranging from 150–200 kg/mm$^2$. This high hardness is retained after annealing at a temperature 200° C. for times up to 100 hours. This is because the intermetallic phases such as $Mg_2Si$ and $Mg_2Ge$ are quite stable and do not coarsen appreciable at temperature up to 250° C.

The as cast ribbon or sheet is typically 25 to 100 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained. Usually the powder comprises of platelets having an average thickness of less than 100 μm. These platelets are characterized by irregular shapes resulting from fracture of the ribbon during comminution.

The powder can be consolidated into fully dense bulk parts by known techniques such as hot isostatic pressing, hot rolling, hot extrusion, hot forging, cold pressing followed by sintering, etc. The microstructure obtained after consolidation depends upon the composition of the alloy and the consolidation conditions. Excessive times at high temperatures can cause the fine precipitates to coarsen beyond the optimal submicron size, leading to a deterioration of the properties, i.e. a decrease in hardness and strength.

Figure 5A:
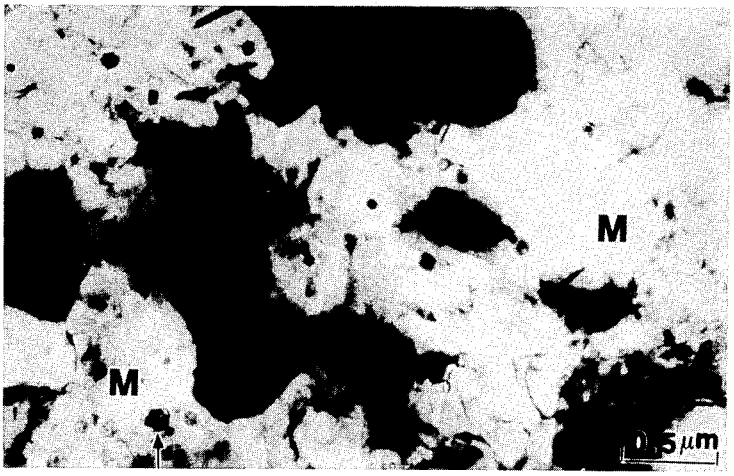
FIG. 5(*a*) is a transmission electron micrograph of extruded bulk compact of alloy $Mg_{88}Al_{10}Si_2$.
Figure 5B:
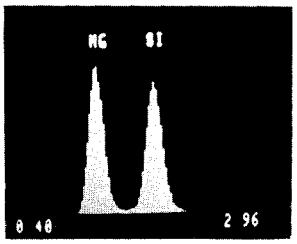
Figure 5C:
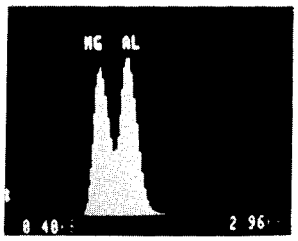

As respresentatively shown in FIG. 5 for alloy $Mg_{88}Al_{10}Si_2$, the compacted consolidated article of the invention is composed of a magnesium solid solution phase (marked M) having an average grain size of 0.5 μm, containing a substantially uniform distribution of dispersed intermetallic phase $Mg_2Si$ (marked by single arrow). Microanalysis of one of such particles is illustrated in FIG. 5(*b*), which shows the x-ray spectrum corresponding to magnesium and silicon peaks. In addition, the microstructure contains aluminum containing precipitates (marked by double arrows) of phase $Mg_{17}Al_{12}$ whose x-ray spectrum is shown in FIG. 5(*c*). This $Mg_{17}Al_{12}$ phase is usually larger than the $Mg_2Si$ phase and is 0.5 to 1.0 μm in size depending on the consolidation temperature. For alloys containing zinc, precipitates of MgZn are also observed.

At room temperature (about 20° C.), the compacted, consolidated article of the invention has a Rockwell B hardness of at least about 55 and is more typically higher than 70. Additionally, the ultimate tensile strength of the consolidated article of the invention is at least about 378 MPa (55 ksi).

The following examples are presented in order to provide a more complete understanding of the invention. The specific techniques, conditions, materials and reported data set forth to illustrate the invention are exemplary and should not be construed as limiting the scope of the invention.

EXAMPLES 1–13

Ribbons were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 100 μm thick.

The nominal compositions of the alloys based on the charge weight added to the melt are summarized in Table I together with their as-cast hardness values. The hardness values are measured on the ribbon surface which is facing the chilled substrate; this surface being usually smoother than the other surface. The microhardness of these aluminum containing magnesium alloys of the present invention ranges from 183 to 270 kg/mm$^2$, as shown in Examples 1–12. For the sake of comparison, microhardness of an alloy $Mg_{89}Al_{11}$ (Examples 13) not of the present invention is listed in Table I. Although the hardness value of 123 kg/mm$^2$ for $Mg_{89}Al_{11}$ alloy is higher than commercially available magnesium alloys, it is much lower than the values obtained for alloys of the present invention.

TABLE I

Composition and as-cast hardness values of magnesium base alloys prepared in accordance with the present invention. The hardness is measured at room temperature.

| Example | Alloy Composition (in atomic %) | Hardness (kg/mm$^2$) |
|---|---|---|
| 1 | $Mg_{87.5}Al_{11}Si_{1.5}$ | 187 |
| 2 | $Mg_{87.25}Al_{11}Si_{1.75}$ | 187 |
| 3 | $Mg_{88}Al_{10}Si_2$ | 186 |
| 4 | $Mg_{87}Al_{11}Ge_2$ | 195 |
| 5 | $Mg_{87}Al_{11}Sn_2$ | 170 |
| 6 | $Mg_{87}Al_{10}Si_3$ | 231 |
| 7 | $Mg_{86}Al_{10}Si_4$ | 239 |
| 8 | $Mg_{89}Al_9Si_2$ | 183 |
| 9 | $Mg_{88}Al_9Si_3$ | 199 |
| 10 | $Mg_{90}Al_8Si_2$ | 203 |
| 11 | $Mg_{89}Al_8Si_3$ | 218 |
| 12 | $Mg_{88}Al_8Si_4$ | 270 |
| 13 | $Mg_{89}Al_{11}$ (alloy outside scope of present invention) | 123 |

EXAMPLES 14–18

Rapidly solidified magnesium base alloy ribbons containing zinc and one or more elements selected from the group consisting of silicon, germanium, cobalt, tin and antimony were made using the procedures described in Examples 1–13. The nominal compositions of the alloys, based on the charge weight added to the melt, are summarized in Table II, together with their as-cast hardness values. For the sake of comparison microhardness of an alloy $Mg_{97}Zn_3$ (Example 18) not of the present invention is also listed in Table II. It can be seen that the microhardness of each of alloys of the present invention is higher than the binary alloy of magnesium and zinc.

TABLE II

Composition and as-cast hardness values of magnesium base alloys prepared in accordance with the present invention. The hardness is measured at room temperature.

| Example | Alloy Composition (in atomic %) | Hardness (kg/mm$^2$) |
|---|---|---|
| 14 | $Mg_{94}Zn_4Si_2$ | 157 |
| 15 | $Mg_{95}Zn_3Si_2$ | 139 |
| 16 | $Mg_{95}Zn_3Co_2$ | 185 |
| 17 | $Mg_{95.88}Zn_2Si_2Zr_{.02}$ | 177 |
| 18 | $Mg_{97}Zn_3$ (alloy outside the scope | 106 |

TABLE II-continued

Composition and as-cast hardness values of magnesium base alloys prepared in accordance with the present invention. The hardness is measured at room temperature.

| Example | Alloy Composition (in atomic %) | Hardness ($kg/mm^2$) |
|---|---|---|
| | of the present invention) | |

EXAMPLES 19–37

Magnesium base alloys containing both aluminum and zinc were cast as rapidly solidified ribbons using the procedure of Examples 1–13. The nominal compositions of the alloys based on charge weight are listed in Table III together with their as-cast hardness. The hardness of some of these quaternary alloys (e.g. Examples 19–23) are substantially higher than the ternary alloys containing either aluminum or zinc. The microhardness of the alloys of the present invention (Examples 19–36) ranges from 134 to 303 $kg/mm^2$ which is higher than that of most commercial magnesium alloys and is also higher than that of the alloy $Mg_{91}Zn_1Al_8$ (Example 37) which is outside the scope of the present invention. It is noteworthy that the microhardness of 200–300 $kg/mm^2$ compares favorably with some of the high strength aluminum alloys, which have higher density.

TABLE III

Composition and as-cast hardness values of magnesium base alloys prepared in accordance with the present invention. The hardness is measured at room temperature.

| Example | Alloy Composition (in atomic %) | Hardness ($kg/mm^2$) |
|---|---|---|
| 19 | $Mg_{85}Zn_3Al_{10}Si_2$ | 263 |
| 20 | $Mg_{84}Zn_3Al_{10}Si_3$ | 285 |
| 21 | $Mg_{87}Zn_3Al_8Si_2$ | 226 |
| 22 | $Mg_{86}Zn_3Al_8Si_3$ | 303 |
| 23 | $Mg_{86.8}Zn_3Al_8Si_{1.5}$ | 227 |
| 24 | $Mg_{88.5}Zn_2Al_8Si_{1.5}$ | 198 |
| 25 | $Mg_{90}Zn_2Al_6Si_2$ | 168 |
| 26 | $Mg_{91}Zn_2Al_5Si_2$ | 159 |
| 27 | $Mg_{92}Zn_2Al_4Si_2$ | 171 |
| 28 | $Mg_{95}Zn_1Al_2Si_2$ | 134 |
| 29 | $Mg_{91}Zn_1Al_6Si_2$ | 149 |
| 30 | $Mg_{91.5}Zn_1Al_6Ge_{1.5}$ | 147 |
| 31 | $Mg_{89}Zn_1Al_8Si_2$ | 192 |
| 32 | $Mg_{89.5}Zn_1Al_8Si_{1.5}$ | 173 |
| 33 | $Mg_{90}Zn_1Al_8Si_1$ | 158 |
| 34 | $Mg_{90.5}Zn_1Al_8Si_{0.5}$ | 151 |
| 35 | $Mg_{90.5}Zn_1Al_8Sb_{0.5}$ | 140 |
| 36 | $Mg_{89.5}Zn_1Al_8Si_1Nd_{0.5}$ | 174 |
| 37 | $Mg_{91}Zn_1Al_8$ (alloy outside the scope of the present invention) | 121 |

EXAMPLE 38

Isothermal and isochronal annealing experiments were conducted on ribbon samples of the alloys of the present invention for times of 1 hr. and 100 hrs. at temperatures of 200° C. and 300° C. Table IV summarizes some typical results of microhardness measurements taken after annealing. It can be seen that the alloys of the present invention retain high hardness after annealing at 200° C. for annealing times up to 100 hrs. The initial increase in hardness after 1 hr. of annealing evidenced by some of the alloys is due to aging of the supersaturated solid solution obtained in as-cast rapidly solidified alloys. The specific time and temperature for obtaining peak hardness during aging depends on the alloy composition and the degree of supersaturation. This aging phenomena is commonly attributed to the precipitation of intermetallic compounds. Samples annealed at 300° C. for as long 100 hrs. do not evidence a substantial decrease in hardness (Table IV). The higher thermal stability of these samples results from formation of intermetallic precipitates such as $Mg_2Si$, $Mg_2Ge$, $Mg_2Sn$, etc, which are quite stable and do not coarsen appreciably.

TABLE IV

Microhardness ($kg/mm^2$) values of magnesium alloys of the present invention after annealing. The hardness is measured at room temperature.

| Alloy | As-Cast Hardness | Annealed at 200° C. 1 hr | Annealed at 200° C. 100 hrs | Annealed at 300° C. 1 hr | Annealed at 300° C. 100 hrs |
|---|---|---|---|---|---|
| $Mg_{87.5}Al_{11}Si_{1.5}$ | 187 | 165 | 195 | 168 | 202 |
| $Mg_{86}Al_{10}Si_3$ | 231 | 224 | 219 | 192 | 185 |
| $Mg_{88}Al_{10}Si_2$ | 186 | 198 | 174 | 159 | 148 |
| $Mg_{90}Al_8Si_2$ | 203 | 221 | 185 | 171 | 148 |
| $Mg_{89}Al_8Si_3$ | 218 | 209 | 184 | 180 | 152 |
| $Mg_{87}Al_{11}Ge_2$ | 195 | 214 | 202 | 181 | 170 |
| $Mg_{87}Al_{11}Sn_2$ | 170 | 195 | 180 | 172 | 150 |
| $Mg_{94}Zn_4Si_2$ | 157 | 169 | 154 | 150 | 133 |
| $Mg_{89}Zn_1Al_8Si_2$ | 192 | 208 | 188 | 162 | 153 |
| $Mg_{89.5}Zn_1Al_8Si_1Nd_{0.5}$ | 174 | 204 | 193 | — | — |
| $Mg_{90.5}Zn_1Al_8Sb_{0.5}$ | 140 | 156 | 141 | — | — |

EXAMPLE 39

The rapidly solidified ribbons of the present invention were subjected first to knife milling and then to hammer milling to produce −60 mesh powders. The powders were vacuum outgased in a can and then sealed under vacuum. The cans were extruded at temperatures of about 200°–250° C. at extrusion ratios ranging from 14:1 to 22:1. The cans were soaked at the extrusion temperature for about 2–4 hrs. Tensile samples were machined from the extruded bulk compacted bars and tensile properties were measured in uniaxial tension at a strain rate of about $10^{-4}$/sec at room temperature. The tensile properties together with Rockwell B ($R_B$) hardness measured at room temperature are summarized in Table V. The alloys of the present invention show exceptionally high hardness ranging from about 70 to about 82 $R_B$. Most commercial magnesium alloys have a hardness of about 50 $R_B$. The density of the bulk compacted samples. Measured by standard immersion technique, is listed in Table V.

TABLE V

Mechanical Properties Of Bulk Consolidated Magnesium Alloys

| Composition (at %) | Extrusion Temp. (°C.) | Extrusion Ratio |
|---|---|---|
| $Mg_{90}Zn_1Al_8Si_1$ | 200 | 18:1 |
| $Mg_{89.5}An_1Al_8Si_{1.5}$ | 200 | 18:1 |
| $Mg_{87.5}Al_{11}Si_{1.5}$ | 200 | 18:1 |
| $Mg_{87}Al_{11}Ge_2$ | 200 | 18:1 |
| $Mg_{88}Al_{10}Si_2$ | 200 | 18:1 |
| $Mg_{87}Al_{10}Si_3$ | 200 | 18:1 |
| $Mg_{86}Al_{10}Si_4$ | 200 | 18:1 |
| $Mg_{87.5}Al_{11}Si_{1.5}$ | 200 | 18:1 |
| $Mg_{90}Al_8Si_2$ | 200 | 22:1 |
| $Mg_{89}Al_8Si_3$ | 200 | 14:1 |
| $Mg_{89}Al_8Si_3$ | 250 | 18:1 |
| $Mg_{92}Al_4Zn_2Si_2$ | 225 | 22:1 |
| $Mg_{89}Al_8Zn_1Si_2$ | 225 | 18:1 |
| $Mg_{89.5}Zn_1Al_8Si_1Nd_{0.5}$ | 200 | 18:1 |

As Extruded Properties (Room Temp.)

| Hardness | Y.S. | UTS | Elogn. | Density |
|---|---|---|---|---|

TABLE V-continued

| ($R_B$) | (0.2%) | (ksi) | (%) | gm/cm$^3$ | lb/in$^3$ |
|---|---|---|---|---|---|
| 70.7 | 53.0 | 60.6 | 5.3 | 1.86 | .0672 |
| 72.5 | 56.5 | 62.2 | 2.8 | 1.84 | .0665 |
| 76.5 | 58.9 | 63.0 | 2.7 | 1.865 | .0674 |
| 81.6 | 65.9 | 69.3 | 1.5 | 1.91 | .0688 |
| 75.1 | 56.1 | 59.3 | 1.3 | 1.83 | .0662 |
| 77.9 | 57.7 | 61.5 | 1.4 | 1.84 | .0665 |
| 81.4 | 67.9 | 69.9 | 0.8 | 1.84 | .0664 |
| 74.8 | 58.9 | 63.2 | 2.7 | 1.82 | .0659 |
| 75.0 | 51.2 | 61.4 | 4.4 | 1.82 | .0657 |
| 80.1 | 70.1 | 71.7 | 1.1 | 1.83 | .0661 |
| 79.2 | 67.9 | 70.7 | 1.2 | 1.852 | .0669 |
| 74.5 | 56.9 | 60.3 | 5.4 | 1.889 | .0682 |
| 78.0 | 64.9 | 67.8 | 1.7 | 1.884 | .0681 |
| 73.2 | 67.6 | 71.1 | 1.6 | 1.88 | .0679 |
| ALLOYS OUTSIDE THE SCOPE OF THE INVENTION | | | | | |
| $Mg_{89}Al_{11}$ | 200 | 22:1 | 63.1 | 45.3 | 54.4 | 5.8 | 1.82 | .0658 |
| $Mg_{91}Zn_1Al_8$ | 200 | 18:1 | 55 | 39.5 | 54.0 | 9.5 | 1.85 | .0668 |
| Commercial alloy ZK60A $Mg_{97.7}Zn_{2.1}Zr_{0.2}$ | | — | 50 | 44 | 53 | 11 | 1.83 | .066 |

Both the yield strength and ultimate tensile strength (UTS) of the alloys of the present invention are exceptionally high. For example, the alloy $Mg_{89}M_8Si_3$ has a yield strength of 70.1 ksi and UTS of 71.7 ksi which approaches the strength of some commercial low density aluminum-lithium alloys. The density of the magnesium alloys of the present invention is only 0.066 lbs/in$^3$ as compared with a density of 0.090 lbs/in$^3$ for some of the advanced low density aluminum-lithium alloys now being considered for aerospace applications. Thus, on a specific strength (strength/density) basis the magnesium base alloys of the present invention provide a distinct advantage in aerospace applications. In some of the alloys ductility as measured by elongation to fracture in excess of 5% is obtained while having UTS of about 60.6 ksi; thus making the alloys suitable for engineering applications. It has been found that by proper choice of thermomechanical processing conditions of the powder (e.g. vacuum outgasing, vacuum hot compaction and then extrusion) the ductility of the same alloy can be improved. Thus, for the alloys that exhibit 1–2% elongation, further improvement in ductility is expected. The alloys of the present invention also find use in military applications such as sabots for armor piercing devices, where high strength is required.

Figure 6A:
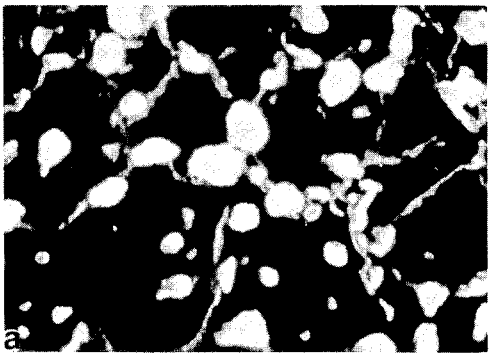
FIG. 6(*a–c*) are scanning electron micrographs of extruded bulk compacts of alloys $Mg_{91}Zn_1Al_8$, $Mg_{90}Zn_1Al_8Si_1$ and $Mg_{89.5}Zn_1Al_8Si_{1.5}$ respectively.
Figure 6B:
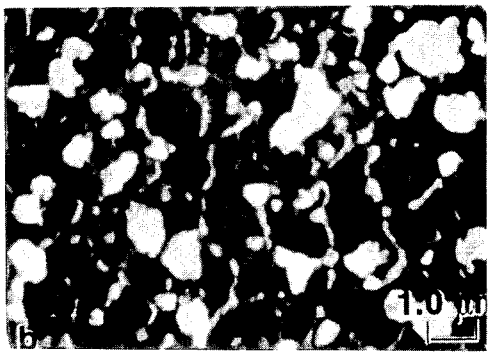
Figure 6C:
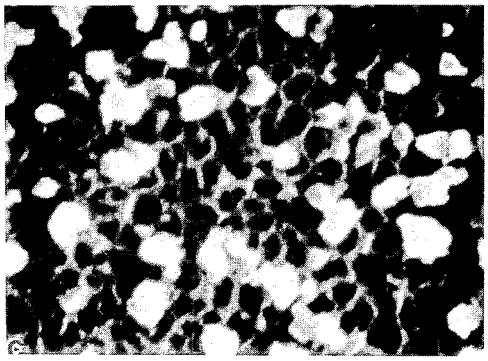

For comparative purpose mechanical properties of rapidly solidified alloys having the compositions $Mg_{89}Al_{11}$ and $Mg_{91}Zn_1Al_8$ are additionally listed in Table V. These alloys (not of present invention) exhibit UTS of about 54 ksi. The absence of alloying elements such as silicon, germanium, tin, antimony and cobalt causes the grains to coarsen rapidly in these alloys during high temperature consolidation. This phenomenon is illustrated in FIG. 6. The alloy $Mg_{91}Zn_1Al_8$, containing no silicon, shows the largest grain size (FIG. 6*a*) while the alloy $Mg_{90}Zn_1Al_8Si_1$ has a finer grain size (FIG. 6*b*) and the alloy $Mg_{89.5}Zn_1Al_8Si_{1.5}$ has even finer grain size (FIG. 6*c*). In these micrographs, the fine $Mg_2Si$ intermetallic precipitates are not visible. These $Mg_2Si$ particles help pin the grain boundaries during high temperature consolidation and maintain a fine grain size in the bulk consolidated compacts.

EXAMPLE 40

A laboratory immersion corrosion test using a solution of 3% sodium chloride in water at 25° C. was devised to compare the corrosion resistance of magnesium alloys relative to each other. The test was generally the same as that recommended by ASTM standard G31-72. The apparatus consisted of a kettle (3000 ml size), a reflex condenser with atmospheric seal, a sparger for controlling atmosphere or aeration, a temperature regulating device, and a heating device. Samples were cut to a size of about 1.6 cm long and 1.0 cm in diameter, polished on a 600 grit sand paper and degreased by rinsing in acetone. The mass of the sample was weighed to an accuracy of ±0.0001 g. The dimension of each sample were measured to ±0.01 cm and the total surface area of each specimen was calculated.

After 96 hours immersion, the specimens were taken out, rinsed with water and dried. The corrosion product on the specimen was removed by bristle brush. Acetone was used to degrease the specimen before weight measurement. The mass loss due to exposure and the average corrosion rate were calculated.

Table VI compares the corrosion rate for one of the alloys ($Mg_{87}Al_{11}Ge_2$) of the present invention with two commercial alloys AZ92A and ZK60A. The corrosion rate of the alloy of the present invention is less than that of either of the commercial alloys. Thus, rapidly solidified alloys of the invention not only evidence improved mechanical properties, but also evidence improved corrosion resistance in salt water.

TABLE VI

Corrosion rates of bulk consolidated magnesium alloys in 3% sodium chloride solution in water measured at 25° C.

| Alloy Composition | Corrosion Rate (mils/year) |
|---|---|
| $Mg_{87}Al_{11}Ge_2$ | 75 |
| Commercial Alloy AS92A $Mg_{91}Al_{8.3}Zn_{0.7}$ | 170 |
| Commercial Alloy ZK60A $Mg_{97.7}Zn_{2.1}Zr_{0.2}$ | 104 |

Having thus described the invention in rather full detail, it will be understood that these details need not be strictly adhered to but that various changes and modifications may suggest themselves to one skilled in the art, all falling within the scope of the invention as defined by the subjoined claim.

What is claimed is:

1. In an apparatus for fabricating continuous metal strip composed of a low density, readily oxidizable magnesium base alloy by casting the alloy directly from the melt through a slotted nozzle onto a moving chill substrate, the improvement which comprises in combination:

(a) scraping means located upstream of said slotted nozzle and being adapted to ride on said substrate and remove the gaseous boundary layer associated therewith, (b) gas supply means disposed between said scraping means and said nozzle for introducing a replacement gas behind said nozzle so that said replacement gas contacts said substrate within 2 to 4 inches of said nozzle and rides on and is carried with said substrate to said nozzle; and (c) shielding means located proximate to said nozzle and configured to form a semi-closed chamber around said nozzle and said substrate, said chamber having a bottom wall comprising said substrate, a top wall comprising said nozzle, side walls comprising a plurality of side shields and a back wall comprising said scraping means, each of said side walls extending from said back wall to a point about 2 to 3 inches past said nozzle slot, said shielding means being operative to direct and confine said replacement gas in the vicinity of said nozzle.

* * * * *